United States Patent [19]

Weber

[11] 4,397,031

[45] Aug. 2, 1983

[54] TIME DELAY COMPUTER

[76] Inventor: Paul A. Weber, Rte. 1, Box 63, Elgin, Okla. 73538

[21] Appl. No.: 212,958

[22] Filed: Dec. 4, 1980

[51] Int. Cl.[3] ..... G04F 10/00

[52] U.S. Cl. ..... 377/20; 364/569; 368/119

[58] Field of Search ..... 235/92 CP, 92 T, 412; 73/167, 518; 364/569; 368/118, 119; 346/38; 324/178

[56] References Cited

U.S. PATENT DOCUMENTS

| | | | |
|---|---|---|---|
| 2,382,981 | 8/1945 | Edgerton | 73/167 |
| 3,227,887 | 1/1966 | Messelt et al. | 324/178 |
| 3,611,134 | 10/1971 | McDowell | 368/119 |
| 3,824,463 | 7/1974 | Oehler | 324/179 |
| 3,956,616 | 5/1976 | Knollenberg | 235/92 |
| 3,968,401 | 7/1976 | Bryant | 235/92 |
| 4,165,459 | 8/1979 | Curtice | 364/569 |
| 4,168,467 | 9/1979 | Bailey et al. | 368/119 |
| 4,234,881 | 11/1980 | Stauers | 368/118 |

*Primary Examiner*—Gary Chin

*Attorney, Agent, or Firm*—Donald J. Singer; Willard R. Matthews

[57] ABSTRACT

The time of arrival of a constant speed moving object at a given location is calculated from data representing the time of arrival of the object at two preceeding locations and the relative physical distances between the three locations. An up-down counter counts up at a fixed frequency $f_1$ during the time interval of the object's transversal of the distance between the first two locations and counts down at a pre-selected frequency $f_2$ thereafter. The preselected frequency $f_2$ is a function of the distances between locations and the fixed frequency $f_1$. When the counter counts down to zero it produces an output pulse that occurs at the time the object reaches the given location. Operation of the time delay computer is independent of object speed.

3 Claims, 3 Drawing Figures

TIME DELAY COMPUTER

STATEMENT OF GOVERNMENT INTEREST

The invention described herein may be manufactured and used by or for the Government for governmental purposes without the payment of any royalty thereon.

BACKGROUND OF THE INVENTION

This invention relates to means for making rapid calculations of adjustable time ratios and in particular to a time delay computer operated recording system adapted to record moving objects at a given location without regard to the objects velocity.

There currently exists various testing and research applications wherein a rapid transient event must be captured by a time sensitive recording media such as photography under circumstances when the exact location of the object of study is important and its speed of propagation is not known in advance. In the field of basic research these applications include optical studies of; shock wave propagation; explosive phenomena; dynamic behavior of machinery; and flame propagation research. Test and evaluation applications include aeroballistic tests involving in-flights photographs of gun launched objects and explosives evaluation.

State-of-the-art methods and techniques used to accomplish these tasks have not been wholly satisfactory, however. Specifically, there currently exists the problem of determining when to operate a recording device such as camera, X-ray generator, or other similar time-sensitive recording device, such that a rapidly moving object or phenomena will be at a desired location when recorded.

Accordingly, there is a present need for equipment that will permit the photographing of a moving object at some arbitrary location along its path. By way of specific example, it would be desirable to photograph a shock wave propagating through a duct at any desired location downstream from two detectors sensitive to its passage without prior knowledge of the speed of the shock. The present invention is directed toward satisfying that need.

SUMMARY OF THE INVENTION

The invention comprehends a time delay computer for producing an output signal at the time at which an object passes a predetermined location. First and second sensors and a recorder such as a camera are positioned along the pathway of a moving object. The first sensor is spaced a predetermined distance $d_1$ from the second sensor, and the second sensor is spaced a predetermined distance $d_2$ from the recorder. Passage of the moving object past the first sensor triggers a first flip-flop which energizes a fixed frequency oscillator. Pulses generated by the oscillator are counted-up by an up-down counter. Passage of the moving object past the second sensor triggers a second flip flop which disconnects the fixed frequency oscillator and energizes a variable frequency oscillator whose pulses are used to count down the counter to zero, whereupon a delayed output signal is delivered to actuate the recorder. The frequency of the variable frequency oscillator is set as a function of the distances $d_1$ and $d_2$ and also as a function of the frequency of the fixed frequency oscillator. The delayed output signal is determined independent of the object's speed, provided the speed remains constant.

It is a principal object of the invention to provide a new and improved time delay computer.

It is another object of the invention to provide a time delay computer implemented recording system that can be operated such that a rapidly moving object will be at a desired location when recorded.

It is another object of the invention to provide a time delay computer implemented recording system of the type described that is independent of the velocity of the object being recorded.

It is another object of the invention to provide a time delay computer implemented recording system of the type described wherein the recording device can be placed at any arbitrary distance from the sensor devices.

These together with other objects, features and advantages of the invention will become more readily apparent from the following detailed description when taken in conjunction with the illustrative embodiment in the accompanying drawings.

DETAILED DESCRIPTION OF THE PREFERRED EMBODIMENT

The invention is an electronic device which measures the time elapsed between two electrical input signals, produces an electrical output signal after a period of time proportional to the elapsed time between the two input signals and the operating frequency of a variable oscillator. If a given time interval represents the time of arrival of an object at two locations separated by a known distance $d_1$ then an output signal occurs a time interval after the object has travelled an additional distance $d_2$, which time interval is determined solely by a specific relationship between distance $d_1$ and the variable oscillator frequency. Distance $d_2$ is independent of the object's speed provided only that its average speed remains constant over distances $d_1$ and $d_2$.

Figure 1:
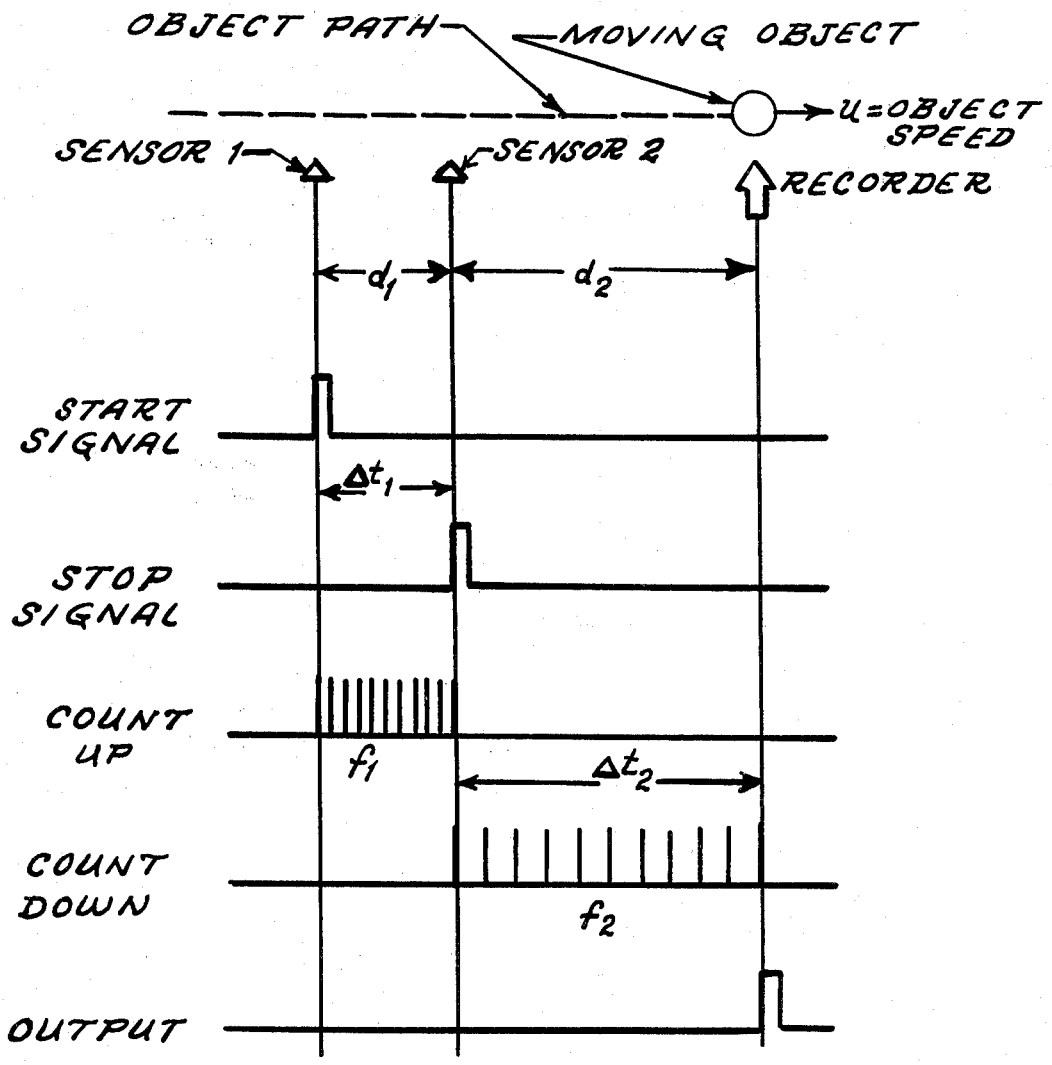
FIG. 1 is a diagram showing the basic time and distance relationships upon which the invention's concept of operation is based.

The basic time and distance relationships upon which the invention's concept of operation is based are illustrated diagrammatically in FIG. 1. In this figure, Sensors 1 and 2 represent devices which produce an electrical output signal when the object of study is in close proximity. They must be located so that the object, moving at speed u, passes them before passing the recording device, and are separated by an arbitrary, but known, distance d.

The horizontal lines labelled "Start Signal" and "Stop Signal" symbolize the electrical outputs of the object sensors as a function of time. The time interval between sensors' signals is $\Delta t_1$.

The horizontal line labelled "Count Up" and the vertical lines on it represents the electrical signal that would result if an electronic oscillator operating at frequency $f_1$ was turned on at the start of time interval $\Delta t_1$ and then turned off at its end. Similarly, the line labelled "Count Down" represents the electrical signal that would result if a second oscillator operating at frequency $f_2$ were turned on only so long as necessary for exactly the same number of cycles of its signal to occur as occurred on the "Count Up" line during the time $\Delta t_1$. This interval is $\Delta t_2$.

The "Output" line represents an electrical signal capable of triggering the operation of the device with which the moving object is to be recorded. It is located an arbitrary, but known, distance $d_2$ from sensor 2.

The time delay computer utilizes these relationships as follows: Frequency $f_1$ pulses are generated by a fixed-frequency oscillator and counted during interval $\Delta t_1$. At the end of this interval, which is signified by the arrival of sensor 2's output signal, the fixed-frequency oscillator is disconnected from the devices which counted the pulses. The counting devices are then immediately connected to a variable frequency oscillator in such a way that each of its pulses subtracts one count from the total which was reached when the fixed oscillator was connected. The frequency of the variable oscillator may be the same, higher, or lower, than the fixed oscillator frequency. The delayed output signal pulse is generated when the counting devices reach zero.

If the object speed u is constant during its passage from sensor 1 to the recording device, then the following mathematical relationships hold:

$$u_s = \frac{d_1}{\Delta t_1}$$

$$d_2 = u_s \Delta t_2 = \frac{d_1}{\Delta t_1} \Delta t_2 = \frac{\Delta t_2}{\Delta t_1} d_1$$

But, also note:

$$\frac{\Delta t_2}{\Delta t_1} = \frac{f_1}{f_2}$$

Therefore:

$$d_2 = \frac{f_1}{f_2} d_1 \quad (1)$$

Or:

$$f_2 = \frac{d_1}{d_2} f_1 \quad (2)$$

Equation (1) shows that for any set of values $f_1$, $f_2$, and $d_1$, the distance from the second sensor to the point at which the object is located when the output signal occurs is a constant that is independent of the object's speed, provided only that the speed has not changed between the first sensor and the camera. Equation (2) gives the frequency at which the variable oscillator should be set so that the output signal will occur when the object is at the same distance $d_2$ for any given $d_1$ and $f_1$.

All of the quantities in Equations (1) and (2) may be measured with any desired precision in advance of the object's passage, thus determining the object's location when the recorder is operated with essentially the same precision.

Figure 2:
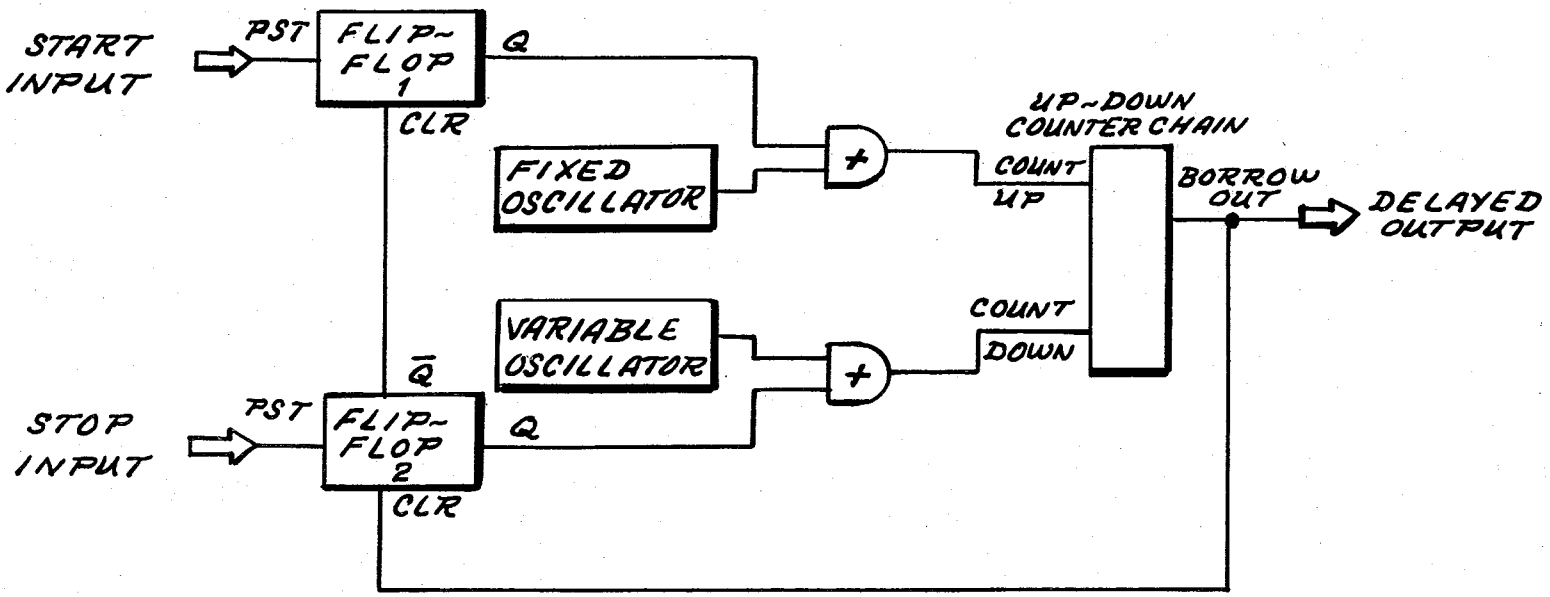
FIG. 2 is a functional block diagram of the time delay computer of the invention.

FIG. 2 in this attachment is a block diagram showing the manner in which the invention's operating principle is implemented. FF1 is a digital electronic flip-flop which is triggered by the sensor 1 output signal. The flip-flop's output causes the fixed-frequency oscillator to be connected to the count-up input of a multiple-decade counter which was initially set at zero.

When sensor 2's signal triggers FF2 at the end of period $\Delta t_1$, FF1's output is returned to the inactive state which disconnects the fixed oscillator. FF2's output simultaneously causes the variable frequency oscillator to be connected to the decade counter's count-down input. When the counters reach zero, a signal representing an attempt to borrow is produced by its least-significant-digit part, which produces the delayed output signal. The borrow signal also clears FF2 and the device is back in its initial condition. This is the essence of the invention.

Figure 3:
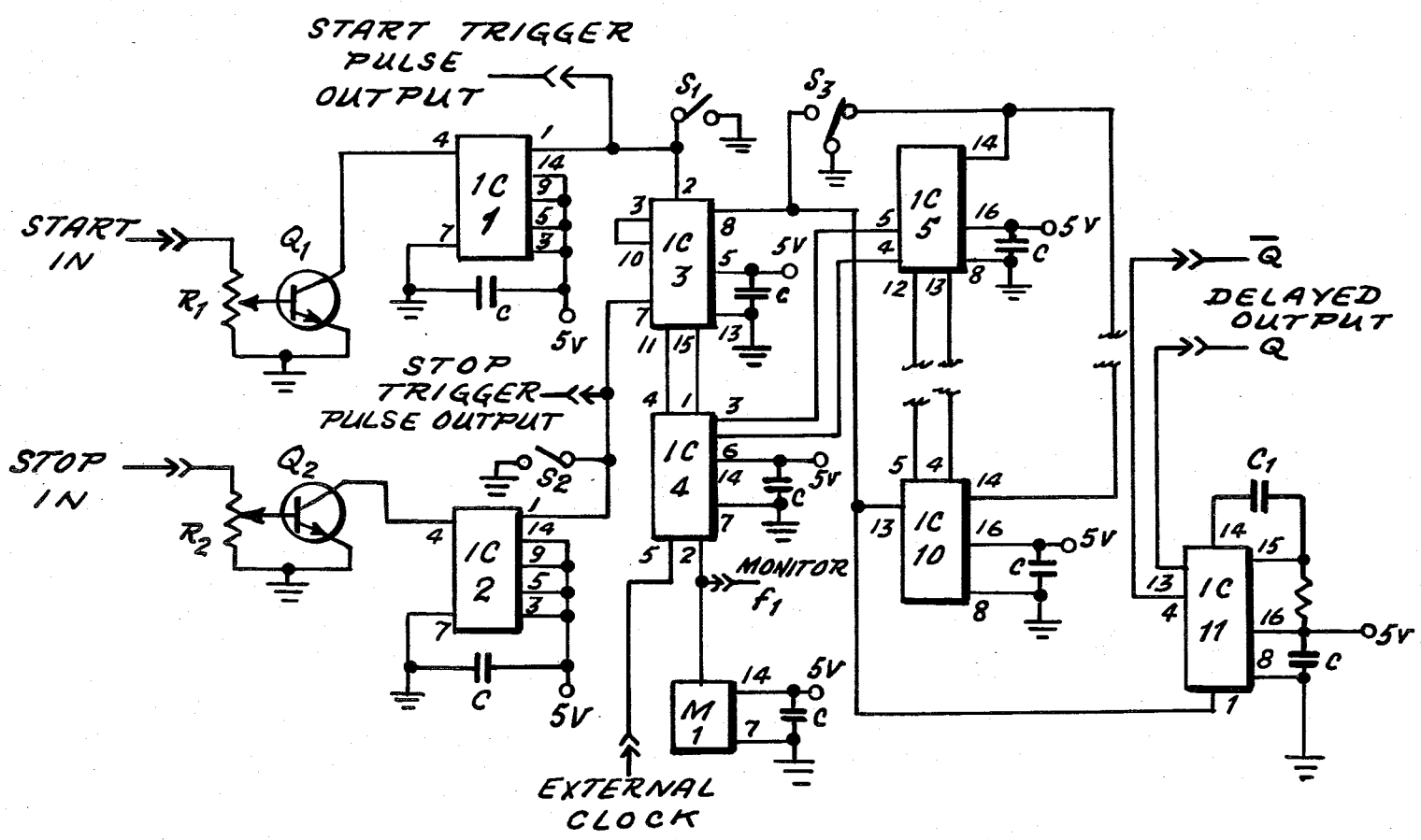
FIG. 3 is a schematic diagram of the time delay computer of the invention.

FIG. 3 is a schematic diagram of a time delay computer which was fabricated according to the principles outlined above. All parts are standard, commercially available, electronic components. The commercial part identification numbers and/or component values are listed in Table 1, Time Delay Computer Parts List. The computer functions in the following manner:

Transistors Q1 and Q2 serve as input buffers and inverters to properly condition non-TTL (Transistor-Transistor Logic) input signals. They are operated as unbiased saturated switches in which the minimum "on" input voltage is set by base-circuit voltage dividing resistors R1 and R2. These buffers may be bypassed if TTL-standard start and stop signals are available.

Integrated circuits IC1 and IC2 are one-shot multivibrators wired to produce a single 30 nanosecond output pulse each time their inputs go low. The start and stop input signals must be of such a nature that they transition only once during the time delay computer's operating cycle.

IC1's output pulse is generated when the device's input is triggered by the sensor 1 signal. This event signifies the start of object speed measurement. The pulse is coupled to the PRESET input of IC3A, one-half of a dual flip-flop. IC3A's Q1 output is ANDed with the fixed-frequency oscillator ($f_1$) in IC4A, one-fourth of a quad NAND gate. Q1's transition applies the oscillator signal to the count-up input of the 6 decade up-down counter chain formed by IC5 through IC10. This chain may be cascaded to any required length if the relationship between $f_1$, $d_1$, and u is such that more than $10^6$ $f_1$ cycles may occur during $\Delta t_1$.

When the moving object causes an output from sensor 2, IC2's one-shot pulse PRESETs IC3B, the $\overline{Q}$2 output of which clears IC3A, thus disconnecting the fixed-frequency oscillator from the counter chain. IC3B's Q2 output is ANDed with the variable frequency oscillator in IC4B, so that this signal is applied to the counter chain count-down input with one clock pulse of the variable frequency oscillator's disconnection.

The borrow-out output of the counter chain's most-significant digit component, IC10, is connected both to IC3B's CLEAR input and to the CLOCK input of IC11, a one-shot multivibrator wired for a single 50 microsecond output pulse. When the counter chain reaches zero after counting down from the up-counted total at a rate determined by the variable frequency oscillator's frequency, IC10's borrow-out pulse simultaneously disconnects the variable frequency oscillator from the chain and produces the system's delayed output pulse through IC11.

The delay computer's fixed-frequency oscillator signal was provided by a crystal controlled module (M1) operating at 10.000 mHz. The variable frequency oscillator's signal was provided by an external signal generator capable of generating TTL-compatible square wave signals at any frequency from 0 to 5 mHz. It is indicated on the schematic by the legend "External Clock". Both fixed and variable frequency oscillators may be external to the basic time delay computer circuit.

In the device described, it is possible to frictionally check total system operation by dry-cycling it and measuring the time required for the counter chain to count completely around ($10^6$ counts). This is accomplished by triggering the delay computer stop input with no start input. Switches S1 and S2 permit such manual triggering and switch S3 clears the counter chain and all flip-flops, as well as generating an output pulse.

IC1 and IC2 pulse outputs were made externally accessable in the device as "Start" and "Stop Channel" pulse outputs. These signals were used to trigger external digital timers which thus documented the time intervals involved.

While the time delay computer was implemented with small and medium scale integrated circuits, the same concept of operation may be realized more compactly with commercially available LSI (Large Scale Integration) up-down devices.

The Time Delay Computer was used in the course of a gasdynamic shock tube experiment to trigger a spark lamp so that schlieren photographs of Mach 3 shock waves could be obtained at a series of closely spaced predetermined locations.

The following Table I indicates specific components that are suitable to use in the above described time delay computer.

TABLE 1

Time Delay Computer Parts List

| | | |
|---|---|---|
| Q1, Q2 | 2N2222A | Silicon NPN Transistor |
| IC1, IC2 | SN74121 | Monostable Multivibrator |
| IC3 | SN7476 | Dual J-K Flip-Flop |
| IC4 | SN7400 | Quad NAND Gate |
| IC5–IC10 | SN74912 | BCD Up-Down Counter |
| IC11 | SN74123 | Dual Monostable Multivibrator |
| R1, R2 | 10 KΩ | Miniature Trimmer Resistor |
| R3 | 1 kΩ, 10% | Composition Resistor |
| C | 0.1 μF, 60 V | Ceramic Capacitor |
| C1 | 1.0 μF, 60 V | Ceramic Capacitor |
| M1 | K1091A | 10.000 mHz Crystal Oscillator Module (Motorola) |

While the invention has been described in its preferred embodiment, it it understood that the words which have been used are words of description rather than words of limitation and that changes within the purview of the appended claims may be made without departing from the scope and spirit of the invention in its broader aspects.

What is claimed is:

1. A time delay computer means comprising:

an up-down counter means, count up actuating means initiating count up from zero operation of said up-down counter at a first fixed frequency $f_1$ in response to a first input signal, said count up actuating means comprising a first flip-flop means receiving said first input signal, a fixed frequency oscillator means generating a signal of frequency $f_1$, and a first AND gate means, said first AND gate means receiving the output of said fixed frequency oscillator means and actuating count-up operation of said up-down counter in response to an enabling signal from said flip-flop means, and count down actuating means disabling said count up actuating means and initiating count down operation of said up down counter means at a second pre-selected frequency $f_2$ in response to a subsequently received second input signal, there being a pre-selected ratio of the time interval between said first and second input signals and the time interval between said second input signal and an output signal generated by the said up-down counter means, said ratio being a function of said second pre-selected frequency $f_2$, said up-down counter means further generating a count down actuating means disabling signal when the counter reaches zero, said count down actuating means comprising, a second flip flop means receiving said second input signal and said count down actuating means disabling signal and providing a disabling signal to said first flip flop means, a variable frequency oscillator means generating a signal of frequency $f_2$, and a second AND gate means, said second AND gate means receiving the output of said variable frequency oscillator means and actuating count down operation of said up-down counter means in response to an enabling signal from said second flip flop means.

2. A time delay computer means as defined in claim 1 wherein said first input signal is derived from a first sensor means, said second input signal is derived from a second sensor means, and said output signal controls a recorder means, said first and second sensor means and said recorder means being physically located in order along a straight line, said second sensor means being positioned between said first sensor means and said recorder means at a distance $d_1$ from said first sensor means and a distance $d_2$ from said recorder means.

3. A time delay computer means as defined in claim 2 wherein the frequency $f_2$ of said variable frequency oscillator means is $f_2 = d_1/d_2\, f_1$.

* * * * *